US008672164B2

(12) United States Patent
Honeyghan

(10) Patent No.: US 8,672,164 B2
(45) Date of Patent: Mar. 18, 2014

(54) DRINKING VESSEL WITH ATMOSPHERIC ASSIST VALVE

(75) Inventor: Vanessa Honeyghan, Cranston, RI (US)

(73) Assignee: MEDport, LLC, Providence, RI (US)

( * ) Notice: Subject to any disclaimer, the term of this patent is extended or adjusted under 35 U.S.C. 154(b) by 188 days.

(21) Appl. No.: 13/045,845

(22) Filed: Mar. 11, 2011

(65) Prior Publication Data

US 2011/0220674 A1 Sep. 15, 2011

Related U.S. Application Data

(60) Provisional application No. 61/313,504, filed on Mar. 12, 2010.

(51) Int. Cl.

| | |
|---|---|
| ***B65D 47/00*** | (2006.01) |
| ***B65D 8/18*** | (2006.01) |
| ***B65D 53/00*** | (2006.01) |
| ***A47G 19/22*** | (2006.01) |

(52) U.S. Cl.

USPC ..... 220/254.3; 220/254.7; 220/375; 220/669; 220/670; 220/703; 220/711; 220/713; 220/714; 220/849; 215/235; 215/306

(58) Field of Classification Search

USPC ..... 220/254.3, 254.7, 256.1, 375, 568, 669, 220/670, 703, 711, 713, 714, 719, 849; 215/235, 306

See application file for complete search history.

(56) References Cited

U.S. PATENT DOCUMENTS

| | | | |
|---|---|---|---|
| 1,805,257 | A | 5/1931 | Pitt |
| 2,325,920 | A | 8/1943 | Rigby |
| 2,685,978 | A | 8/1954 | Crockett |
| 3,059,816 | A | 10/1962 | Goldstein |
| 3,187,965 | A | 6/1965 | Bourget |
| 3,204,829 | A | 9/1965 | Song |
| 3,275,201 | A | 9/1966 | Tedeschi et al. |
| 3,655,102 | A | 4/1972 | Moran |
| 3,863,798 | A | 2/1975 | Kurihara et al. |
| 4,779,766 | A | 10/1988 | Kinsley |
| 4,782,985 | A | 11/1988 | Kinsley |
| 5,005,717 | A | 4/1991 | Oilar |

(Continued)

OTHER PUBLICATIONS

PROFLEX (registered trademark) Material Safety Data Sheet—GE-S Series Thermoplastic Elastomer, circa 2008.

(Continued)

*Primary Examiner* — Anthony Stashick
*Assistant Examiner* — Madison L Poos
(74) *Attorney, Agent, or Firm* — Cook Alex Ltd.

(57) ABSTRACT

Drinking vessels have an elongated container body joined with a closure body having a dispensing orifice and a vent orifice, each in fluid-passing communication with the interior of the container body. A closure arm is rotatably mounted near one end of it and has at least two sealing members spaced from each other along the length of the closure arm, one of the sealing members opening and closing the vent opening while another of the sealing members opens and closes the vent opening while another of the sealing members opens and closes the dispensing orifice when the closure arm is rotated between its open and closed positions. At least the sealing member for the vent orifice has an elastomeric surface that sealingly engages a surface at the vent orifice when at the closed position. Elastic surfaces can instead or in addition be provided at the vent orifice surface or one or both opposing surfaces of the dispensing area.

10 Claims, 7 Drawing Sheets

(56) References Cited

U.S. PATENT DOCUMENTS

| | | | | |
|---|---|---|---|---|
| 5,037,015 | A | 8/1991 | Collins | |
| 5,299,718 | A | 4/1994 | Shwery | |
| 5,558,239 | A * | 9/1996 | Dubach | 215/235 |
| 5,615,808 | A | 4/1997 | Huang | |
| 5,615,809 | A | 4/1997 | Feer et al. | |
| 5,875,941 | A | 3/1999 | Hsu | |
| 6,102,245 | A | 8/2000 | Haberman | |
| D462,236 | S | 9/2002 | Huribut | |
| D485,123 | S | 1/2004 | Gullickson et al. | |
| 6,702,137 | B1 | 3/2004 | Kowa et al. | |
| 6,702,138 | B1 | 3/2004 | Bielecki et al. | |
| D491,022 | S | 6/2004 | Bodum | |
| 6,745,915 | B2 | 6/2004 | Rees | |
| D499,603 | S * | 12/2004 | Nikkhah | D7/378 |
| 6,935,536 | B2 | 8/2005 | Tardif | |
| D510,235 | S | 10/2005 | Sorensen | |
| D513,916 | S | 1/2006 | Namee | |
| D513,918 | S | 1/2006 | Bodum | |
| 7,073,678 | B1 | 7/2006 | Dibdin et al. | |
| D541,106 | S * | 4/2007 | Spiegel | D7/510 |
| D566,469 | S | 4/2008 | Tien | |
| D571,610 | S | 6/2008 | Bodum | |
| D572,083 | S | 7/2008 | Tien | |
| D587,069 | S | 2/2009 | Bodum | |
| D589,751 | S | 4/2009 | Liu et al. | |
| D592,455 | S | 5/2009 | Germann | |
| D593,365 | S | 6/2009 | Miller et al. | |
| D597,365 | S | 8/2009 | Oas | |
| 7,740,147 | B1 | 6/2010 | Gilbert | |
| D632,918 | S | 2/2011 | Gordon | |
| 2002/0104820 | A1 * | 8/2002 | Hong et al. | 215/381 |
| 2003/0136783 | A1 * | 7/2003 | Hatsumoto et al. | 220/254.3 |
| 2009/0014407 | A1 * | 1/2009 | Strasser et al. | 215/381 |

OTHER PUBLICATIONS

FIT & FRESH Vortex Hydrator, circa. Aug. 2008.

* cited by examiner

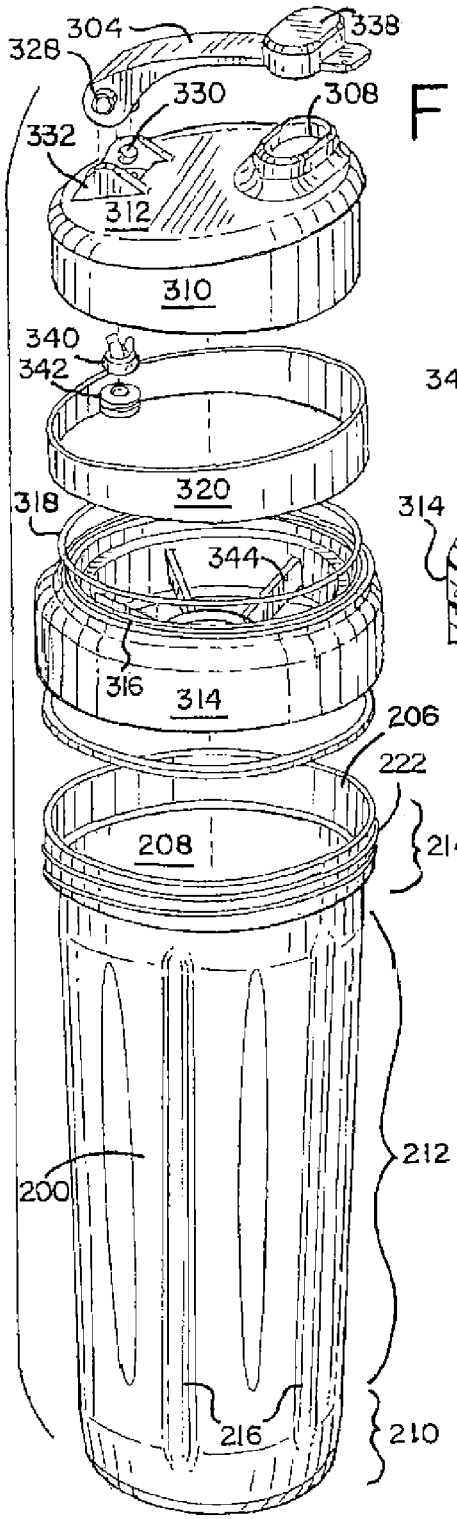
FIG. 11
FIG. 12
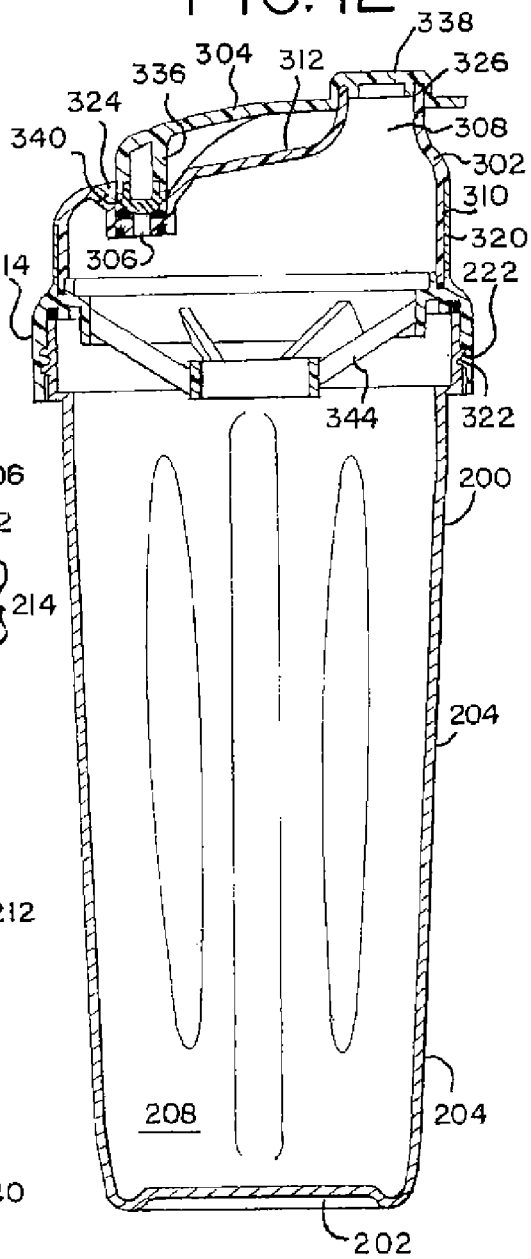

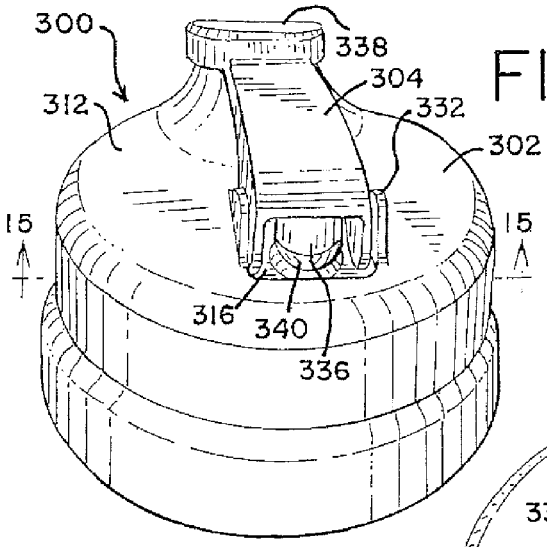
FIG. 13
FIG. 14
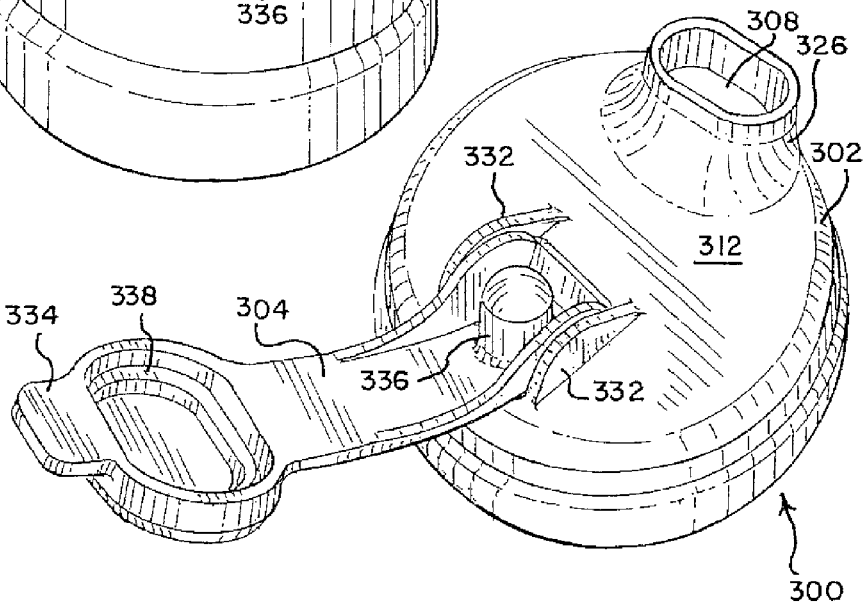
FIG. 15
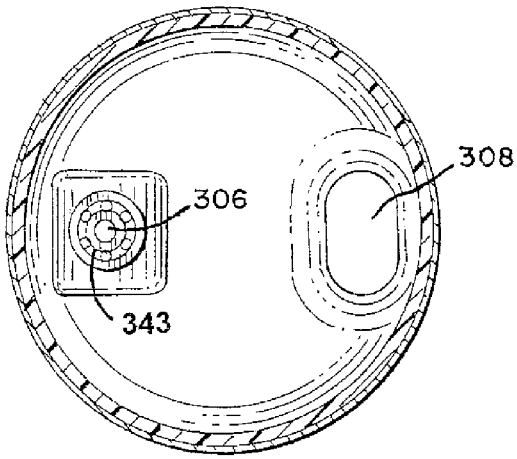

FIG. 16
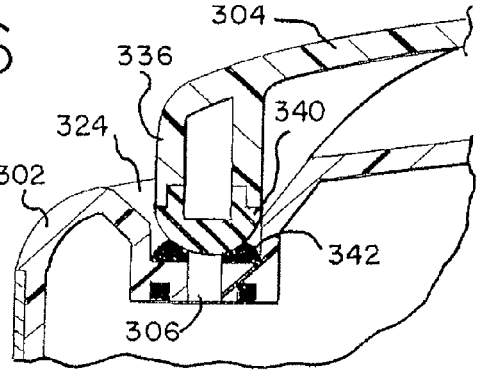
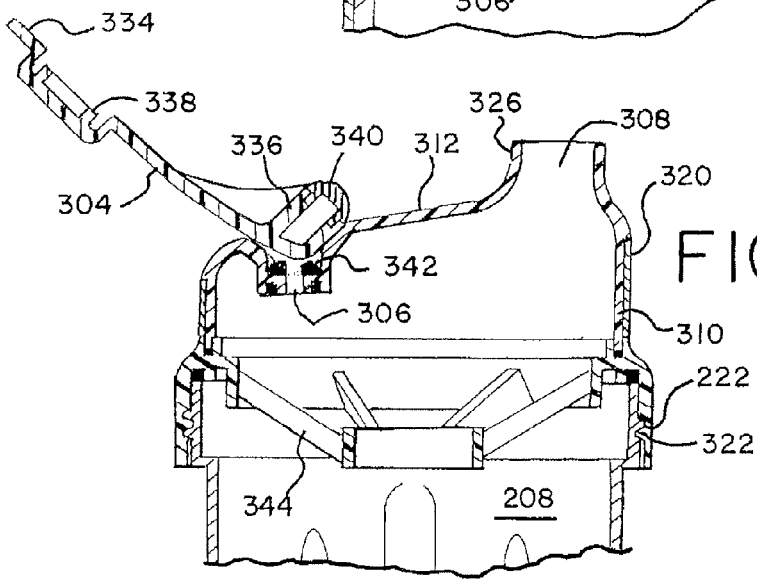
FIG. 17
FIG. 18
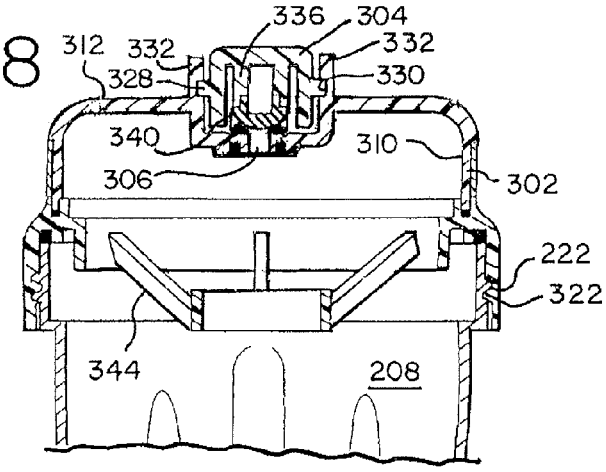

DRINKING VESSEL WITH ATMOSPHERIC ASSIST VALVE

CROSS REFERENCE TO RELATED APPLICATIONS

This application claims the benefit of U.S. Provisional Application No. 61/313,504, filed Mar. 12, 2010, which is incorporated herein by reference in its entirety.

BACKGROUND

1. Field of the Disclosure

The present invention generally relates to drinking vessels for containing and dispensing its contents such as beverages. More particularly, this invention relates to drinking vessels having an improved structure that includes an opening for dispensing the contents from the drinking vessel and has an additional opening for venting air into the drinking vessel. The structure further includes a closure for sealing both openings and a fluid flow interrupter for mixing the beverage in the vessel.

2. Description of Related Art

There are numerous portable drinking vessels which are commonly sold and used for the containment of beverages such as water, juice, soft drinks or shakes. Typically, such containers have a lid which covers an opening through which the vessel is filled. The lid often includes an opening for dispensing the contents from the vessel. However, it is desirable for the vessels to also include a vent opening in order to equalize the internal air pressure of the container and thus, allow the user to more easily withdraw the beverage from container. Without establishing such equilibrium, the vacuum created within the container makes it more difficult to generate the flow of the contents out of the vessel. The addition of a vent opening allows air to pass in and out of the drinking vessel and equalizes air pressure during extraction of its contents through the dispensing opening. Therefore, drinking vessels often require a vent opening in order to operate efficiently; however, when not in use, the dispensing opening and vent opening must be sealed to prevent undesirable spilling or leakage of the contents from the vessel which is undesirable to the user or consumer.

Various closure means have been implemented for these drinking vessels but such approaches have had certain shortcomings which prevent them from achieving a totally satisfactory solution. Often, such closure means do not always provide a fluid-tight closure of the openings and therefore provide an avenue by which the contents can escape unintentionally from the drinking vessel. Accordingly, it would be desirable to provide a drinking vessel with a closure that creates a fluid-tight seal with the vent opening.

In addition, problems arise with current drinking vessels when the beverage begins to settle toward the bottom of the drinking vessel. Upon settling, the beverage, such as orange juice, within the drinking vessel is no longer properly mixed to the user's taste preferences. In other instances, powders or the like are blended into a liquid carrier while both are within the drinking vessel itself. It would be desirable to provide a portable drinking vessel that allows the user to have the capability of remixing or initially stirring the contents within the drinking vessel without the need to remove the contents from the container body or mix them prior to entry into the container.

SUMMARY

In accordance with an embodiment of the present invention, a drinking vessel is provided which includes an elongated container body defining an interior cavity with an open end. The vessel further includes a generally cylindrical closure body selectively engageable over the open end of the container body. The closure body includes a lid component and a closure arm. The lid component includes a wall having a dispensing orifice and a vent orifice. Each of these orifices is in fluid-passing communication with the interior cavity of the container body. The closure arm is pivotally connected to the wall of the lid component at a location proximate the vent orifice and is movable between a closed position and an open position. The closure arm includes a first sealing member positioned for engaging the vent orifice when in the closed position and a second sealing member positioned for engaging the dispensing orifice when in the closed position.

In another embodiment, the drinking vessel comprises an elongated container body defining an interior cavity with an open end and a generally cylindrical closure body selectively engageable over the open end of the container body. The closure body includes a lid component and a closure arm, while the container body includes an outer surface. A first portion of the outer surface has a generally circular cross-sectioned cylindrical shape and a second portion of the outer surface has a generally polygonal cross-sectioned cylindrical shape, these first and second portions being longitudinally spaced with respect to each other. The lid component includes a wall having a dispensing orifice and a vent orifice, wherein each orifice is in fluid-passing communication with the interior cavity of the container body. The closure arm is pivotally connected to the wall of the lid component at a location proximate the vent orifice and movable between a closed position and an open position, the closure arm including a first sealing member sized, structured and positioned for engaging and sealing the vent orifice when in the closed position and for unsealing the vent orifice when in the open position, the closure arm including a second sealing member sized, structured and positioned for engaging and sealing the dispensing orifice in the closed position and for opening the dispensing orifice in the open position. This first sealing member further includes an elastomeric member that cooperates with a gasket of the vent orifice to provide a fluid-tight seal when the closure arm is in the closed position.

In a further embodiment, the drinking vessel comprises an elongated container body defining an interior cavity with an open end. Also included is a generally cylindrical closure body selectively engageable over the open end of the container body, the closure body including a lid component and a closure arm. The container body includes an outer surface, a first portion of the outer surface has a generally circular cross-sectioned cylindrical shape and a second portion of the outer surface has a generally polygonal cross-sectioned cylindrical shape, these first and second portions being longitudinally spaced with respect to each other. The lid component includes a wall having a dispensing orifice and a vent orifice, wherein each orifice is in fluid-passing communication with the interior cavity of the container body. The closure arm is pivotally connected to the wall of the lid component at a location proximate the vent orifice and movable between a closed position and an open position, with the closure arm having a first sealing member sized, structured and positioned for engaging and sealing the vent orifice when in the closed position and for unsealing the vent orifice when in the open position. Further, the closure arm includes a second sealing member sized, structured and positioned for engaging and sealing the dispensing orifice in the closed position and for opening the dispensing orifice in the open position, and the first sealing member further includes an elastomeric member that cooperates with a gasket of the vent orifice to provide a fluid-tight seal when the closure arm is in the closed position. The second portion of the outer surface further includes a plurality of spaced protrusions, and the generally polygonal cross-section shape of the second portion of the outer surface is substantially hexagonal.

BRIEF DESCRIPTION OF THE DRAWINGS

In the course of this description, reference will be made to the accompanying drawings, wherein:

FIG. 11 is an exploded perspective view of the drinking vessel shown in FIG. 1;

FIG. 12 is a longitudinal cross-sectional view of FIG. 1;

FIG. 13 is a perspective view of an embodiment of a lid of the present invention with the closure arm in the closed state;

FIG. 14 is a perspective view of the lid of FIG. 13 with the closure arm in the open state;

FIG. 15 is a bottom plan view of the lid of FIG. 13;

FIG. 16 is an enlarged view of the interaction of the sealing member and venting orifice as shown in FIG. 12 and while in the closed state;

FIG. 17 is a longitudinal cross-sectional view of an embodiment of a lid of the present invention with the closure arm in the open state along with an upper portion of the drinking vessel body; and FIG. 18 is a longitudinal cross-sectional view of the lid shown in FIG. 17, along with an upper portion of the drinking vessel body, rotated 90° from FIG. 17.

DETAILED DESCRIPTION

Figure 1:
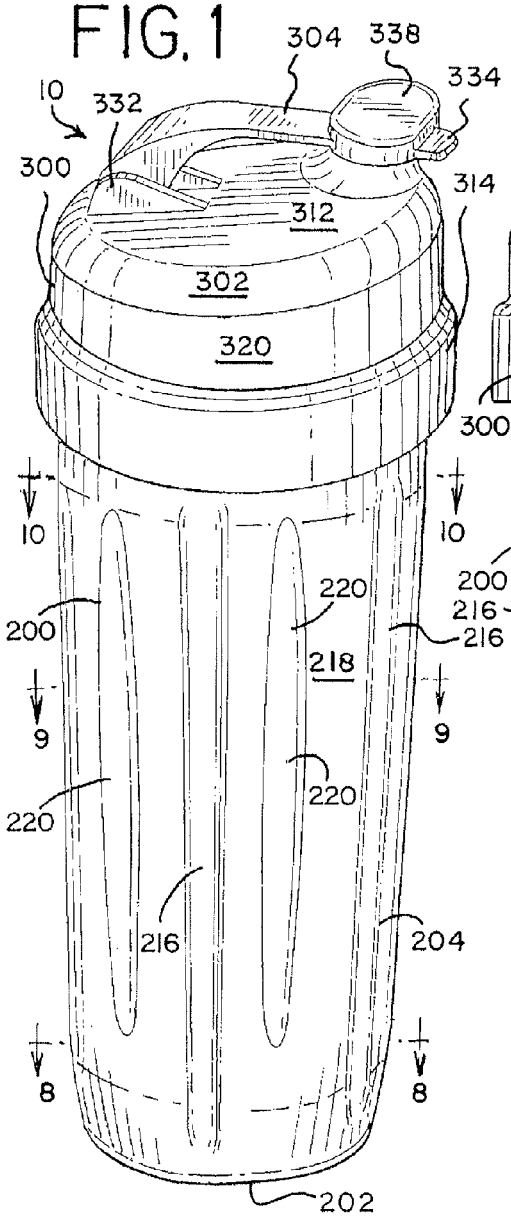
FIG. 1 is a perspective view of an embodiment of a drinking vessel of the present invention.
Figure 2:
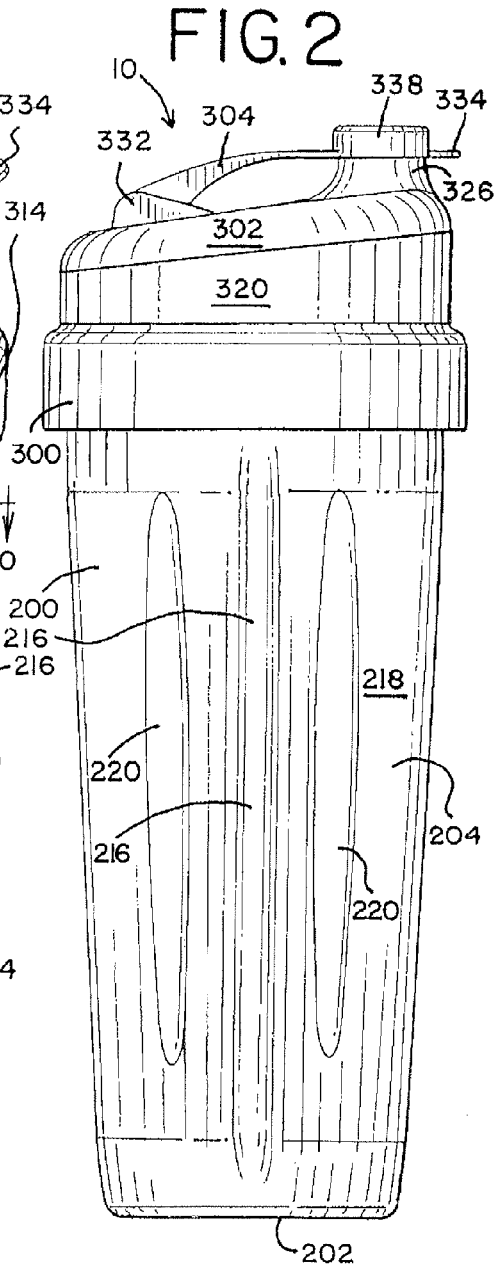
FIG. 2 is a side elevational view of the drinking vessel shown in FIG. 1.
Figure 3:
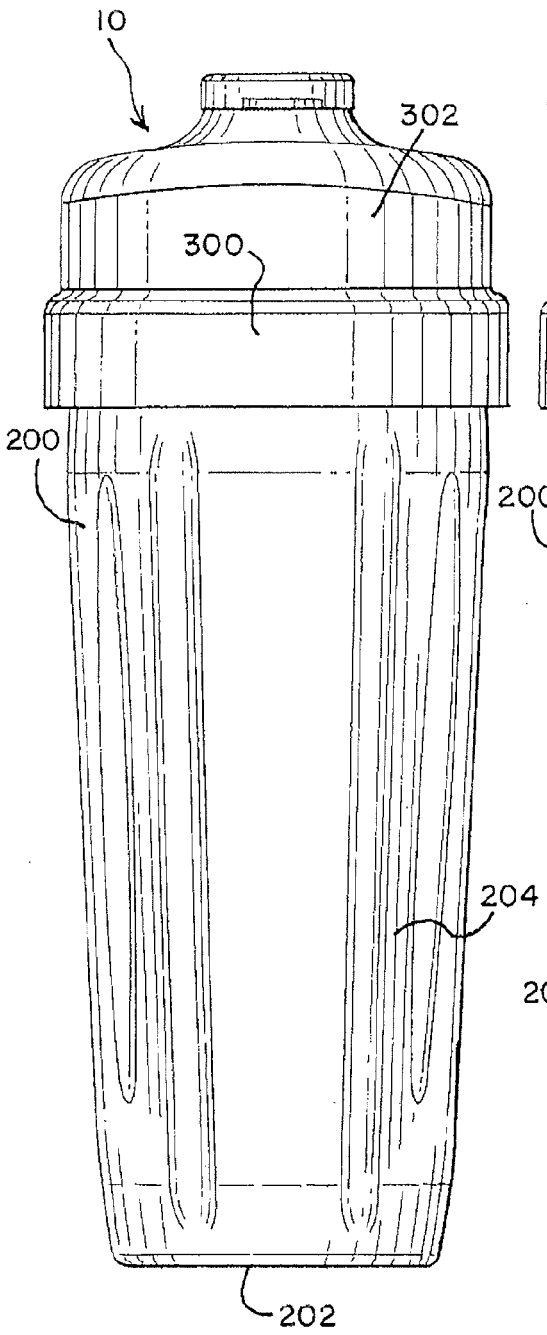
FIG. 3 is another side elevational view of the drinking vessel shown in FIG. 1, rotated 90° with respect to FIG. 2.
Figure 4:
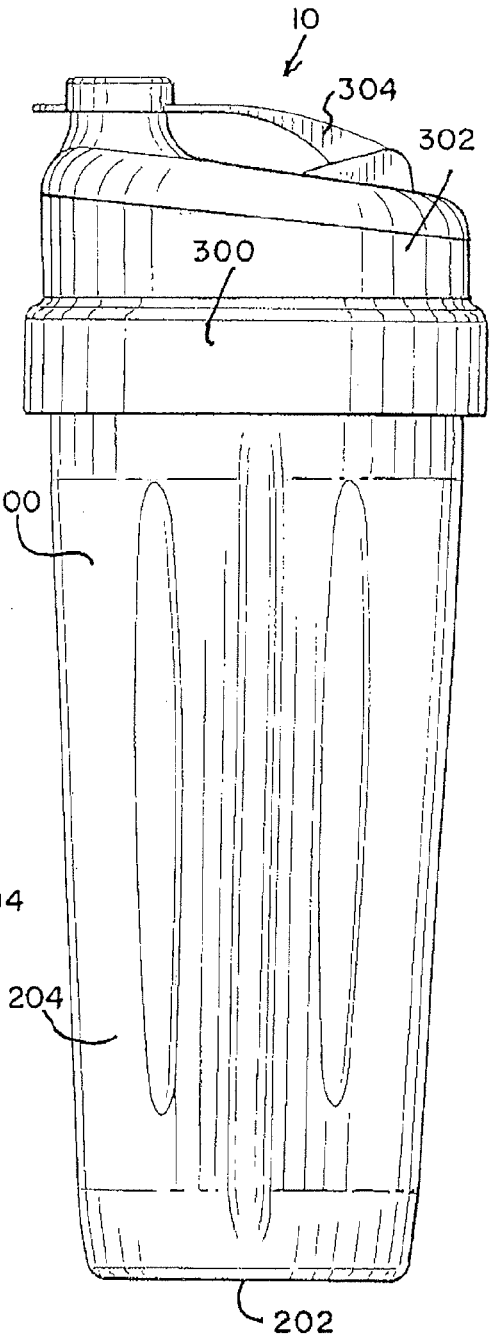
FIG. 4 is another side elevational view of the drinking vessel shown in FIG. 1, rotated 90° with respect to FIG. 3.
Figure 5:
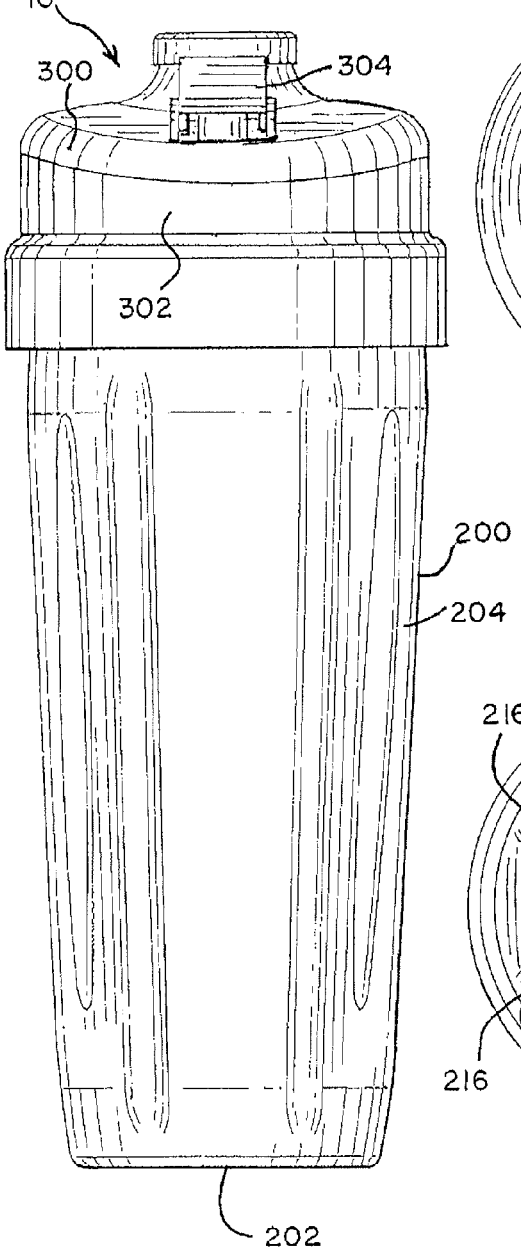
FIG. 5 is another side elevational view of the drinking vessel shown in FIG. 1, rotated 90° with respect to FIG. 4.
Figure 6:
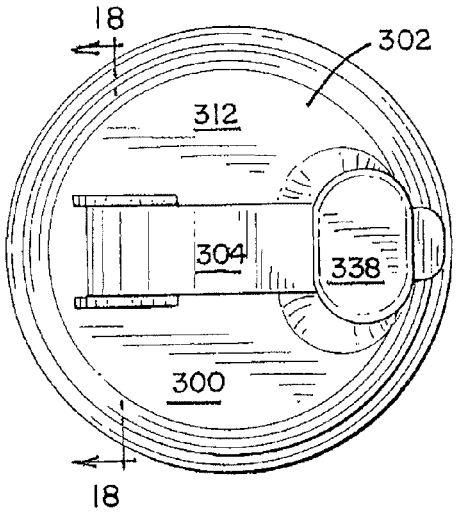
FIG. 6 is a top plan view of the drinking vessel shown in FIG. 1.
Figure 7:
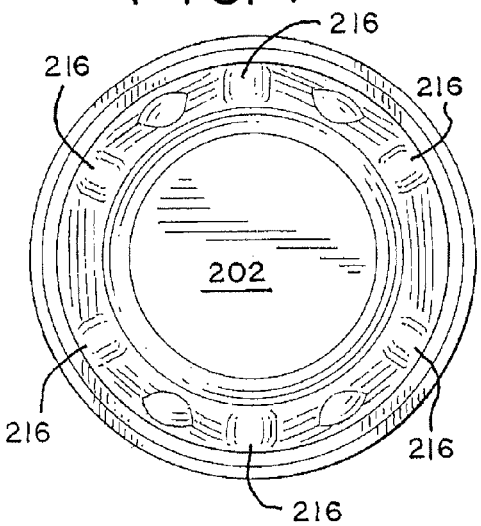
FIG. 7 is a bottom plan view of the drinking vessel shown in FIG. 1.

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention and virtually any appropriate manner.

As described in more detail in the discussion of the different embodiments, the drinking vessels of the present disclosure have an improved structure that generally includes an opening for dispensing the contents from the drinking vessel and has an additional opening for venting air into the drinking vessel. The structure further includes a closure which provides for a fluid-tight seal of both openings and a fluid flow interrupter for mixing beverage contents while within the drinking vessel.

Turning to the embodiment of a drinking vessel illustrated in FIGS. 1-18, the drinking vessel 10 generally includes a container body 200 and a closure body 300 releasably mounted to the container body 200. The closure body 300 includes a lid component 302 and a closure arm 304. The closure arm 304 is movable between a closed position (see FIG. 13) wherein the closure arm 304 seals a vent orifice 306 and a dispensing orifice 308 and an open position (see FIG. 14) where the closure arm 304 is spaced from or otherwise does not seal the orifices.

In the illustrated embodiment, the container body 200 has a generally elongated shape, preferably generally cylindrical, with a bottom wall 202 and an upstanding side wall 204 which terminates in an open mouth 206. Together the bottom wall 202 and side wall 204 define an interior cavity 208 (see FIG. 11) which is sized and configured for receiving and temporarily storing a beverage, such as water, juices, soft drinks, energy drinks, supplement drinks, or shakes. It will be appreciated that the container body 200 may have any convenient configuration and its form may depend, in part, on the type of container desired.

In order to help a user better grip or otherwise hold the drinking vessel 10, the outer surface of the container body 200 is ergonomically shaped. As perhaps best illustrated in FIG. 11, the upstanding side wall 204 of the container body 200 has an outer surface that includes a bottom portion 210, gripping portion 212 and top portion 214. The gripping portion 212 includes a plurality of protrusions 216 which extend longitudinally along at least the gripping portion 212 and preferably almost along the entire outer surface. These protrusions 216 are circumferentially spaced from one another around the outer surface of the gripping portion 212. In the illustrated embodiment, there are six protrusions 216 substantially equally spaced around the outer surface of the gripping portion 212. However, it will be appreciated that other numbers and spacing of the protrusions 216 are contemplated by the present disclosure.

The outer surface includes landing areas 218 positioned between every neighboring protrusion 216. In the illustrated embodiment, there are six landing areas 218, although the number of landing areas 218 can differ depending on the number of protrusions 216. In order to further affect the shape of the outer surface, additional protrusions 220 are placed on at least some of the landing areas 218. In the illustrated embodiment, the protrusions 220 are shorter than protrusions 216 and are generally oblong shaped. In the illustrated embodiment, a shorter protrusion 220 is positioned generally centered on four of the six landing areas. It will be appreciated that size, number, shape and placement of the protrusions 220 may be changed, if desired.

Figure 8:
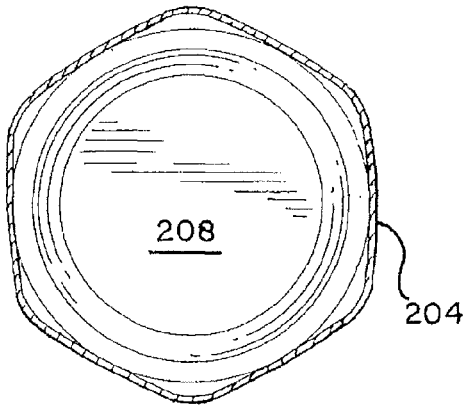
FIG. 8 is a cross-sectional view along the line 8-8 of FIG. 1.
Figure 9:
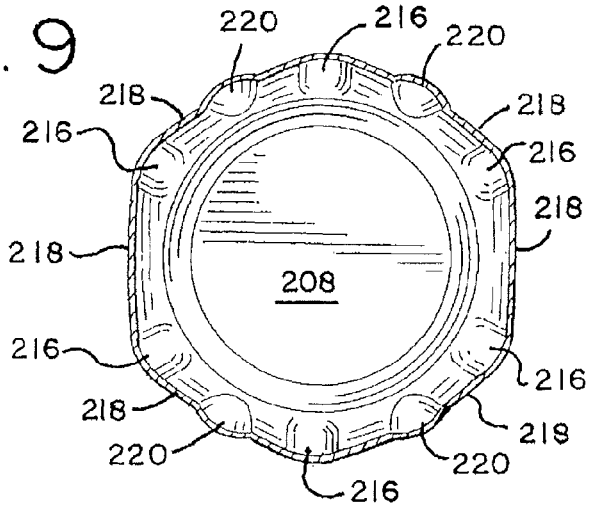
FIG. 9 is a cross-sectional view along the line 9-9 of FIG. 1.
Figure 10:
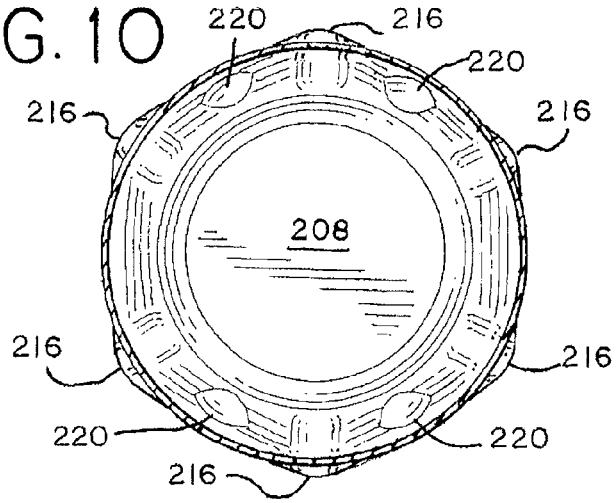
FIG. 10 is a cross-sectional view along the line 10-10 of FIG. 1.

The placement of these protrusions 216 and 220 helps define the shape of the outer surface of the container body 200 and more specifically the gripping portion 212 to provide an ergonomical outer surface that allows for better gripping or holding of the drinking vessel 10. The bottom wall 202 of the container body 200 has a generally circular outer surface (see FIG. 7), the placement of protrusions on the outer surface of the side wall changes the cross sectional configuration moving up the outer surface. As shown in FIG. 8 (a cross-sectional view along the line 8-8 of FIG. 1), the outer surface of the side wall 204 towards the bottom of the gripping portion 212 has a generally polygonal shape and more specifically, a generally hexagonal shape. Moving up the side wall 204, the hexagonal shape of the outer surface of the gripping portion 212 is altered with the addition of the shorter protrusions on four of the landing areas 218 which are the faces of the hexagon (see FIG. 9, a cross-sectional view along the line 9-9 of FIG. 1). Continuing to move up the side wall at an area outside of the gripping portion 212, the outer surface of the side wall 204 returns to a generally circular shape (see especially FIG. 10, a cross-sectional view along the line 10-10 of FIG. 1).

The container body 200 is typically constructed from a high strength, lightweight material such as conventional polymers or metals suitable for containing food and beverage products. In the illustrated embodiment, the container body 200 is constructed of stainless steel and the protrusions 216 and 220 are stamped into the steel (see FIG. 12). However, it is understood by those skilled in the art that the shape and material used to construct the container body and protrusion can be modified without departing from the spirit and scope of the invention. For example, the protrusions can be separately formed of a different material and attached to the outer surface.

As mentioned above, the open mouth 206 of the container body 200 is closed by the closure body 300 which generally includes a lid component 302 and a closure arm 304. The lid component 302 and closure arm 304 are typically molded and more specifically injection molded, out of conventional polymers such as polypropelenes. However, it will be appreciated that the invention is not limited to these materials and that any suitable material may be used.

As best shown in FIGS. 6 and 11-15, the lid component 302 preferably is generally circular in order engage the top portion of the container body. The lid component 302 has a flange 310 which extends downward from a top surface 312. In the illustrated embodiment, the top surface 312 is generally sloped; however, it will be appreciated that the top surface 312 may have a variety of configurations including being generally flat, convex or concave.

In the illustrated embodiment, the lid component 302 further includes a skirt 314 which has a circumferential recess 316 defined on the top surface 312. The recess 316 is sized to tightly receive an end portion of flange 310. A gasket 318 may be positioned within recess 316 in order to render a fluid-tight seal between flange 310 and skirt 314. Alternatively, the skirt and flange could be integrally formed. Optionally, a decorative element 320 may be positioned around at least a portion of flange 310. In the illustrated embodiment, the decorative element 320 is a stainless steel ring. It is appreciated that the decorative element 320 could be constructed of different materials or may also serve as a surface for the imprinting of trademark, advertising or graphical materials for the purposes of branding, advertising or promotion. However, it also will be understood by those skilled in the art that the shape and material used to construct the lid component 302 can be modified without departing from the spirit and scope of the invention. For example, the lid component 302 can be virtually in the form of any shape that is capable of covering the open mouth 206 of the container body 200.

As mentioned above, the container body 200 is selectively secured to the closure body 300. In the illustrated embodiment, the top portion 214 of the container body 200 includes threads 222 for selectively engaging corresponding grooves 322 on an interior surface of the lid component 302 of the closure body 300. Accordingly, the container body 200 and closure body 300 may thus be selectively threadedly engaged or disengaged as desired. When the components are engaged the interior cavity 208 is formed into a closed, fluid-tight cavity.

As perhaps best illustrated in FIG. 12, grooves 322 are formed on the lid component 302 and more specifically an interior surface of skirt 314 of the lid component 302. Although it will be appreciated that the grooves 322 could be located elsewhere on the lid component 302, if desired. Alternatively, one could swap the location of the threads and grooves such that the threads 222 are defined on the lid component 302 and the grooves 322 are defined on the container body 200. In addition, it will be appreciated that the closure body 300 could be selectively secured to the container body 200 via a variety of other mechanisms without departing from the spirit and scope of the invention. For example, the lid component 302 could be snap fit or friction fit to the container body 200 without the use of threads.

In order to allow the beverage to be selectively dispensed from the drinking vessel 10 and to allow the flow air into the interior cavity 208 of the container body 200 during use, the lid component 302 defines a dispensing orifice 308 and a vent orifice 306 on the top surface 312. Both of these orifices 306 and 308 are passageways which extend completely through the top Surface 312. In the illustrated embodiment, the vent orifice 306 is a bore which is positioned within a depression 324 on the top surface 312. The depression 324 is sized to receive at least an end portion of the closure arm 304 and allow the closure arm 304 to be pivoted without interference with the top surface 312. As shown in the drawings, the dispensing orifice 308 is surrounded by a raised annular spout 326 which allows a user to more easily drink the contents of the drinking vessel 10.

In order to allow the user to selectively dispense the contents from the drinking vessel, the closure body 300 includes an elongated closure arm 304 that is pivotally mounted to the lid component 302. In the illustrated embodiment a hinge configuration allows the closure arm 304 to be pivoted by the user between a closed position (see FIG. 13) and an open position (see FIG. 14). When the closure arm 304 is in the open position, the orifices 306 and 308 are generally unobstructed and when the closure arm 304 is in the closed position, the orifices 306 and 308 are sealed in order to prevent the contents from flowing out of the interior cavity 208 of the drinking vessel 10.

It will be appreciated that any variety of hinge configurations could be used; however, in the embodiment shown in FIG. 18, the hinge is formed by the cooperating interaction of pivot pins 328 and sockets 330. A pivot pin 328 is formed on opposing sides of one end of the closure arm 304. Each pivot pin 328 is seated within a socket 330 formed on the lid component 302. In the illustrated embodiment, a socket 330 is formed on an interior wall of a pair of spaced apart upstanding shoulders 332 positioned on the top surface 312 of the lid component 302. More specifically, the shoulders 332 bracket the depression 324 which includes the vent orifice 306 positioned therewithin. As perhaps best shown in FIG. 17, when the closure arm 204 is pivoted to its open position, the end of the closure arm 204 that is hinged to the lid component 302 rotates in such a way that the vent orifice is not completely obstructed and air can flow around the closure arm 204, into the depression 324 in the lid component 302, through the vent orifice 306 and ultimately into the interior cavity 208 of the drinking vessel 10. As illustrated, when in the open position, the closure aim 204 acts as a shield to substantially prevent debris from entering contaminating the contents of the interior cavity 208 of the drinking vessel.

It will be appreciated that the shoulders 332 may be integrally formed with the lid component 302 or alternatively separately secured to the top surface by any conventional assembly techniques known in the art. Alternatively, the location of the pins 328 and sockets 330 could be interchanged such that the pins 328 are formed on the shoulders 332 and the sockets 330 are formed on the closure arm 304. Further, one skilled in the art will appreciate a variety of other configurations that allow the closure arm to pivot between the open and closed positions may be used without departing from the spirit and scope of the invention. For example, the closure arm may be integrally constructed with the lid component and form a "living" hinge.

In order to help the user more readily grasp and move the closure arm 304 between the open and closed positions, at least one tab 334 may be formed on the closure arm. In the illustrated embodiment, the tab 334 is located at the free end of the closure arm 304 and is sized and configured for grasping by the user. It will be appreciated that the tab 334 may be positioned elsewhere on the closure arm 304 or have other configurations than illustrated.

The closure arm 304 includes at least two sealing members which are used to create a fluid-tight seal with the vent and dispensing orifices. The first sealing member 336 interacts with the vent orifice 306 and the second sealing member 338 interacts with the dispensing orifice 308. The sealing members 336 and 338 are positioned on the closure arm 304 such that each member engages its respective orifice when the closure arm 304 is in the closed position. When engaged, each sealing member and its respective orifice cooperate to seal and otherwise prevent the contents from unintentionally spilling or leaking out of the drinking vessel 10.

In the illustrated embodiment, the first sealing member 336 includes projection or plug which extends from a bottom surface of the closure arm 304. The projection is positioned such that when the closure arm 304 is in the closed position the first sealing member 336 cooperatively engages with the vent orifice 306 to prevent fluid flow therethrough. Preferably, the first sealing member 336 further includes an elastic seal member 340, such as an elastomer, that covers at least an end of the projection. In the embodiment illustrated in FIG. 16, the seal member 340 has one or more fingers which fit into one or more slots in the projection on the closure aim 304. Alternatively, the seal member 340 could be overmolded or otherwise attached to the projection.

A gasket 342 surrounds the vent orifice 306 on the top surface of the lid component 302 to help form a fluid-tight seal between the first sealing member 336 and vent orifice 306. When the closure arm 304 is in the closed position, the gasket 342 cooperatively interacts with first sealing member and more specifically the seal member 340 on the end of the projection. In the illustrated embodiment, the gasket 342 is an elastomer that is overmolded into a channel 343 formed on the bottom surface of the lid component 302. The gasket 342 has a disc shaped end that creates a rim around the vent orifice 306. Preferably, the gasket 342 is a thermoplastic elastomer; however, it is appreciated that other materials may be used. Examples include Trefsan™ elastomers and Proflex® thermoplastic elastomers, such as Proflex GE-S Series elastomers. Included are compositions of styrenic block copolymers, including blends thereof with polypropylene and/or processing oil and other conventional additives.

In the embodiment illustrated in FIG. 14, the second sealing member 338 is a well or receptacle defined in the second end portion of the closure arm 304. The well is sized to sealingly receive or engage the annular spout 326 of the dispensing orifice 308 when the closure arm 304 is in the closed position. It is to be understood that the first and second sealing members may have other suitable configurations. For example, the second sealing member 338 could also be or include a plug formation that extends into and tightly engages the annular spout 326 when the closure arm 304 is in the closed position.

It will be appreciated that elastomeric surfaces or components can be provided to enhance sealing at either or both of the vent or dispersing passageway components. Elastomeric surfaces or components can be provided on either or both of the closure arm side or the lid component side.

The drinking vessel 10 may further include a fluid flow interrupter 344 positioned within the interior cavity 208 for agitating, stirring or mixing of the contents of the drinking vessel. In the illustrated embodiment, the fluid flow interrupter 344 is connected to the skirt 314 of the lid component 302. More specifically, the interrupter 344 in the embodiment shown in the figures includes multiple spokes which extend or slope generally downward into the interior cavity 208 from an inner flange of the skirt 314. The spokes are spaced apart from one another enough to allow fluid to flow relatively easily therethrough but also to provide enough disturbance to the fluid. The spokes are connected to one another via a central hub. As shown, the interrupter 344 is constructed of a plastic material such as polypropylene; however, it is appreciated that a variety of other suitable materials may be used. It will also be understood by those skilled in the art that there are a variety of other suitable ways and forms to include fluid flow interrupters in the drinking vessel without departing from the spirit and scope of the invention. For example, the interrupter may be a separate piece that is inserted into the interior cavity. Also the interrupter can be stationary or moveable.

In operation, a user may insert the desired beverage through the open mouth 206 and into the interior cavity 208 of the container body 200. The user may selectively secure the closure body 300 to the top portion 214 of the container body 200. With the closure arm 304 in the closed position, a user may manually or otherwise shake the drinking vessel to create a disturbance of the beverage within the drinking vessel 10. When the user desires to drink the beverage, the user may pivot the closure aim 304 to the open position to unseal the dispensing orifice 308 and venting orifice 306. In this position, the beverage can be selectively dispensed from the dispensing orifice 308 and air can enter through the venting orifice 306 into the interior cavity 208 of container body 200 to allow the beverage to be dispensed out of the drinking vessel 10 more rapidly and with less exertion by the user. When the user no longer wants to dispense the beverage, the closure arm 204 can be pivoted back to the closed position such that each sealing member engages its respective orifice and create a fluid-tight seal.

It will be understood that the above examples are merely exemplary of the drinking vessel and valve arrangement of the present disclosure. Variations of these examples may become apparent to those of ordinary skill in the art upon reading the foregoing description. It will be appreciated that skilled artisans may employ such variations as desired, and drinking vessels and valves of the present disclosure may be constructed otherwise than as specifically described herein. Accordingly, all modifications and equivalents of the subject matter described herein are intended to be covered by the claims appended hereto as permitted by applicable law. Moreover, any combination of the above-described elements and all possible variations thereof are encompassed by the present disclosure unless otherwise indicated herein or otherwise clearly contradicted by context.

I claim:

1. A drinking vessel for storing and selectively dispensing a beverage, the drinking vessel comprising:

an elongated container body defining an interior cavity with an open end and a bottom wall;

the container body includes an outer surface, a first portion of the outer surface terminates at the open end, has a generally circular cross-sectioned cylindrical shape and extends to a second portion of the outer surface, the second portion has a generally hexagonal cross-sectioned cylindrical shape, and extends from the first portion substantially to the bottom wall;

the second portion of the outer surface further includes a plurality of spaced protrusions that extend longitudinally along an otherwise generally circular cross-sectioned cylindrical shape, the protrusions being circumferentially spaced therealong to define the generally hexagonal cross-sectioned second portion;

the second portion of the outer surface further includes a plurality of additional protrusions positioned respectively between two of the spaced protrusions, the additional protrusions also extending longitudinally;

a generally cylindrical closure body selectively engageable over the open end of the container body, the closure body includes a lid component and a closure arm;

the lid component includes a wall having a dispensing orifice and a vent orifice, wherein each orifice is in fluid-passing communication with the interior cavity of the container body;

the closure arm is pivotally connected to the wall of the lid component at a location proximate the vent orifice and movable between a closed position and an open position, the closure arm includes a first sealing member sized, structured and positioned for engaging and sealing the vent orifice when in the closed position and for unsealing the vent orifice when in the open position, the closure arm including a second sealing member sized, structured and positioned for engaging and sealing the dispensing orifice in the closed position and for opening the dispensing orifice in the open position; and, a fluid flow static interrupter positioned within the interior cavity of the contained body and extending from the closure body into the interior cavity.

2. The drinking vessel of claim 1, wherein the first sealing member further includes an elastomeric member that cooperates with a gasket of the vent orifice to provide a fluid-tight seal when the closure arm is in the closed position.

3. The drinking vessel of claim 1, wherein the closure arm further includes a pin positioned on opposing sides of the closure arm, each pin fits into a respective socket defined on the lid component to allow the closure arm to pivot between the open and closed positions.

4. The drinking vessel of claim 3, wherein each socket is defined in upstanding shoulders of the lid component.

5. The drinking vessel of claim 4, wherein the upstanding shoulders bracket the vent orifice.

6. The drinking vessel of claim 1, wherein the closure arm further includes a well which receives an annular spout formed on the wall of the lid component around the dispensing orifice.

7. The drinking vessel of claim 1, wherein the closure arm further includes a tab which facilitates moving the closure arm between the open and closed positions.

8. The drinking vessel of claim 1, wherein the closure arm further includes a pin positioned on either side of the closure arm, each pin engages a respective socket of lid component, and each socket is defined in upstanding shoulders of the lid component, and the upstanding shoulders bracket the vent orifice.

9. A drinking vessel for storing and selectively dispensing a beverage, the drinking vessel comprising:

an elongated container body defining an interior cavity with an open end and a bottom wall;

a generally cylindrical closure body selectively engageable over the open end of the container body, the closure body includes a lid component and a closure arm;

the container body includes an outer surface, a first portion of the outer surface terminates at the open end, has a generally circular cross-sectioned cylindrical shape and extends to a second portion of the outer surface, the second portion has a generally polygonal cross-sectioned cylindrical shape that is substantially hexagonal and extends from the first portion substantially to the bottom wall;

the second portion of the outer surface further includes a plurality of spaced protrusions that extend longitudinally along an otherwise generally circular cross-sectioned cylindrical shape, the protrusions being circumferentially spaced therealong to define the generally polygonal cross-sectioned second portion;

the lid component includes a wall having a dispensing orifice and a vent orifice, wherein each orifice is in fluid-passing communication with the interior cavity of the container body;

the closure arm is pivotally connected to the wall of the lid component at a location proximate the vent orifice and movable between a closed position and an open position, the closure arm includes a first sealing member sized, structured and positioned for engaging and sealing the vent orifice when in the closed position and for unsealing the vent orifice when in the open position, the closure arm including a second sealing member sized, structured and positioned for engaging and sealing the dispensing orifice in the closed position and for opening the dispensing orifice in the open position;

the first sealing member further includes an elastomeric member that cooperates with a gasket of the vent orifice to provide a fluid-tight seal when the closure arm is in the closed position;

the second portion of the outer surface further includes a plurality of spaced additional protrusions positioned respectively between two of the spaced protrusions, the additional protrusions also extending longitudinally; and further comprising a fluid flow static interrupter positioned within the interior cavity of the container body, and the fluid flow interrupter extends from the closure body into the interior cavity.

10. The drinking vessel of claim 9, wherein the closure arm further includes a pin positioned on opposing sides of the closure arm, each pin fits into a respective socket defined on the lid component to allow the closure arm to pivot between the open and closed positions; and each socket is defined in upstanding shoulders of the lid component, and the upstanding shoulders bracket the vent orifice.

* * * * *